US010877414B2

(12) United States Patent
Takemasa

(10) Patent No.: US 10,877,414 B2
(45) Date of Patent: Dec. 29, 2020

(54) IMAGE FORMING APPARATUS WITH A FIXING DEVICE CONTROLLED FOR ENVELOPE PRINTING

(71) Applicant: CANON KABUSHIKI KAISHA, Tokyo (JP)

(72) Inventor: Rikiya Takemasa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/688,176

(22) Filed: Nov. 19, 2019

(65) Prior Publication Data

US 2020/0159153 A1 May 21, 2020

(30) Foreign Application Priority Data

Nov. 20, 2018 (JP) ..... 2018-217145

(51) Int. Cl.
*G03G 15/20* (2006.01)
*G03G 15/00* (2006.01)

(52) U.S. Cl.
CPC ..... *G03G 15/2064* (2013.01); *G03G 15/2039* (2013.01); *G03G 15/5016* (2013.01); *G03G 15/6588* (2013.01); *G03G 15/6594* (2013.01); *B65H 2301/142* (2013.01); *G03G 2215/00514* (2013.01); *G03G 2215/00742* (2013.01)

(58) Field of Classification Search
CPC ..... G03G 15/2039; G03G 15/2064; G03G 15/5016; G03G 15/5029; G03G 15/6588; G03G 15/6591; G03G 15/6594; G03G 2215/00514; G03G 2215/00586; G03G 2215/00742; B65H 2301/133; B65H 2301/1422
USPC ..... 399/67, 328; 271/2
See application file for complete search history.

(56) References Cited

U.S. PATENT DOCUMENTS 9,897,953 B2 * 2/2018 Takahashi ..... G03G 15/2053
2005/0141932 A1 * 6/2005 Sugiyama ..... G03G 15/2064 399/328
2007/0160375 A1 * 7/2007 Fujisawa ..... G03G 15/2032 399/45

(Continued)

FOREIGN PATENT DOCUMENTS

JP 61294477 A * 12/1986
JP 2007-271681 A 10/2007

(Continued)

*Primary Examiner* — Robert B Beatty
(74) *Attorney, Agent, or Firm* — Venable LLP

(57) ABSTRACT

An image forming apparatus including an image forming portion, a fixing device, a pressure switching mechanism, and a controller. The fixing device includes a fixing member, a heating portion, and a pressing member. The pressure switching mechanism is configured to switch pressure between the fixing member and the pressing member. The controller is configured to execute an operation in an image forming mode in which the image is capable of being formed on an envelope. The controller is configured to cause the pressure switching mechanism to switch the pressure to a first pressure when an instruction to form the image on an address side of the envelope is inputted and to cause the pressure switching mechanism to switch the pressure to a second pressure when an instruction to form the image on a non-address side of the envelope is inputted. The second pressure is higher than the first pressure.

7 Claims, 10 Drawing Sheets

(56) References Cited

U.S. PATENT DOCUMENTS

| | | | | |
|---|---|---|---|---|
| 2013/0140767 | A1* | 6/2013 | Inui | B65H 5/00 271/264 |
| 2018/0299807 | A1* | 10/2018 | Matsuura | G03G 15/2053 |
| 2019/0094751 | A1* | 3/2019 | Watanabe | G03G 15/0858 |
| 2019/0187594 | A1* | 6/2019 | Matsuura | G03G 15/2042 |
| 2020/0033772 | A1* | 1/2020 | Hirano | G03G 15/5016 |

FOREIGN PATENT DOCUMENTS

| | | | | |
|---|---|---|---|---|
| JP | 2017090549 | A | * | 5/2017 |
| JP | 2017156475 | A | * | 9/2017 |
| JP | 2019086648 | A | * | 6/2019 |

* cited by examiner

| KIND | SHORT-SIDE LENGTH | SHAPE (PASTING) |
|---|---|---|
| Monarch | 98. 4mm | DIAMOND |
| COM10 | 104. 8mm | CONSTANZIA DIAMOND |
| DL | 110mm | CONSTANZIA DIAMOND |
| LONG 3 | 120mm | CENTER SIDE |
| WESTERN 3 | 120mm | CONSTANZIA DIAMOND |
| ISO-C5 | 162mm | CONSTANZIA DIAMOND |
| SQUARE 2 | 240mm | CENTER SIDE |

IMAGE FORMING APPARATUS WITH A FIXING DEVICE CONTROLLED FOR ENVELOPE PRINTING

CROSS-REFERENCE TO RELATED APPLICATIONS

This application claims the benefit of Japanese Patent Application No. 2018-217145 filed on Nov. 20, 2018 which is hereby incorporated by reference herein in its entirety.

FIELD OF THE INVENTION AND RELATED ART

The present invention relates to an image forming apparatus, such as a printer, a copying machine, a facsimile machine or a multi-function machine using an electrophotographic type.

In the image forming apparatus of the electrophotographic type or the like, a toner image is formed on a recording material at a transfer portion and thereafter the recording material is fed to a fixing device in order to fix the toner image on the recording material. When the recording material fed to the fixing device passes through a fixing nip formed by a fixing roller and a pressing roller, the toner image formed on the recording material is fixed on the recording material by being heated and pressed.

In recent years, the image forming apparatus is used for printing an image on, as a recording material, an envelope in addition to sheets such as plain paper, thick paper, rough paper, embossed paper, and coated paper (Japanese Laid-Open Patent Application (JP-A) 2007-271681). In the image forming apparatus disclosed in JP-A 2007-271681, a pressure of the fixing nip (nip pressure) is set at different values between the case when the toner image is fixed on the plain paper by the fixing device and the case when the toner image is fixed on the envelope by the fixing device.

Conventionally, during fixing of the toner image on the envelope, the same nip is set for an address side and a non-address side with the result that there was a liability that a stepped portion trace (envelope crease) is generated when fixing of the toner image on the address side of the envelope or that improper fixing of the toner image occurs with fixing of the toner image on the non-address side of the envelope. This is because the envelope is formed in a bag shape and a thickness of the envelope is different between a portion where paper (sheet) and paper (sheet) are pasted to each other and another portion and therefore pressures actually exerted on the envelope at the portions when the envelope passes through the fixing nip can different from each other. However, in the case of the envelope, it is difficult to set nip pressure which is optimum for fixing the toner images on both the address side and the non-address side and which his common to the address side and the non-address side, and, even when the common nip pressure can be set, adjustment of the common nip pressure requires much time and is troublesome. Therefore, a constitution in which toner images can be fixed on the address side end the non-address side of the envelope has been conventionally desired, but such a constitution has not been proposed yet.

SUMMARY OF THE INVENTION

A principal object of the present invention is to provide an image forming apparatus capable of properly fixing toner images on an address side and a non-address side of an envelope.

According to one aspect the present invention provides an image forming apparatus capable of forming an image on a recording material including an envelope. The image forming apparatus including an image forming portion, a fixing device, a pressure witching mechanism, and a controller. The image forming portion is configured to form a toner image on the envelope. The fixing device includes a fixing member, a heating portion configured to heat the fixing member, and a pressing member. The pressing member contacts the fixing member and forms a nip where the envelope is nipped and fed. The fixing device is configured to fix the toner image on the envelope by heat and pressure. The pressure switching mechanism is configured to switch pressure between the fixing member and the pressing member. The controller is configured to execute an operation in an image forming mode in which the image is capable of being formed on the envelope. The controller being configured to cause the pressure switching mechanism to switch the pressure to a first pressure when an instruction to form the image on an address side of the envelope is inputted and to cause the pressure switching mechanism to switch the pressure to a second pressure when an instruction to form the image on a non-address side of the envelope is inputted. The second pressure is higher than the first pressure.

Further features of the present invention will become apparent from the following description of exemplary embodiments with reference to the attached drawings.

Figure 7:
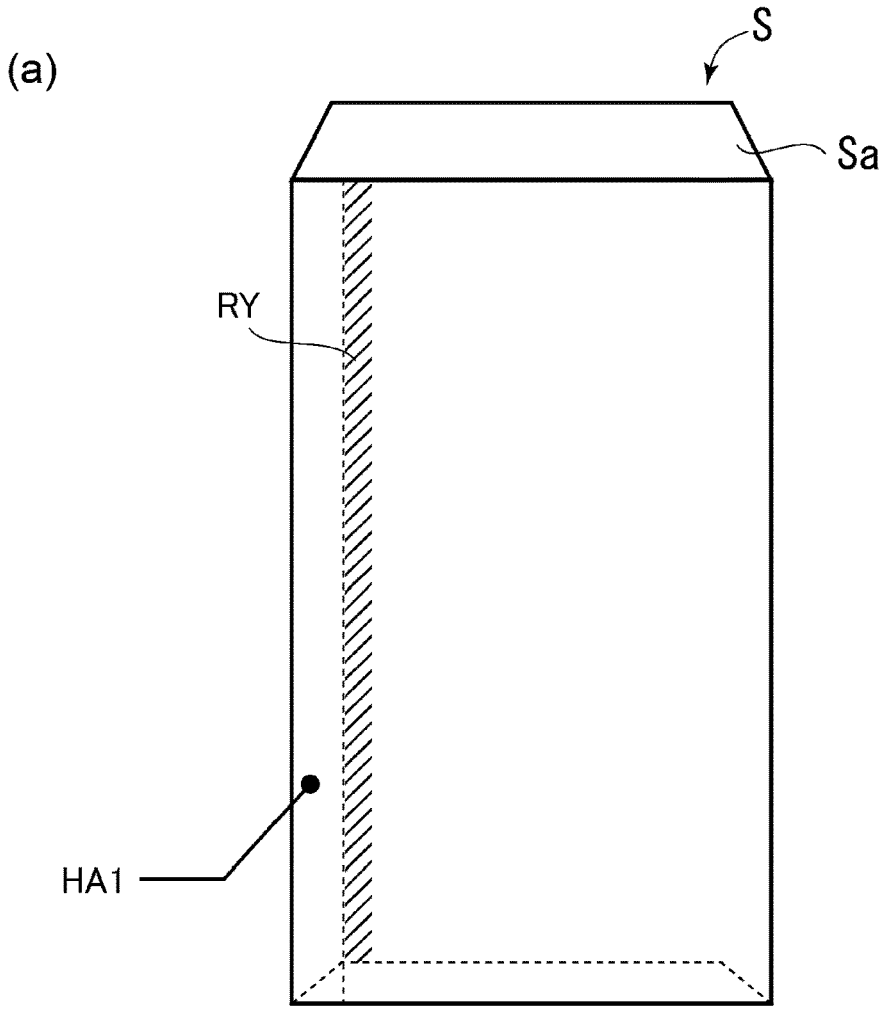
Figure 7:
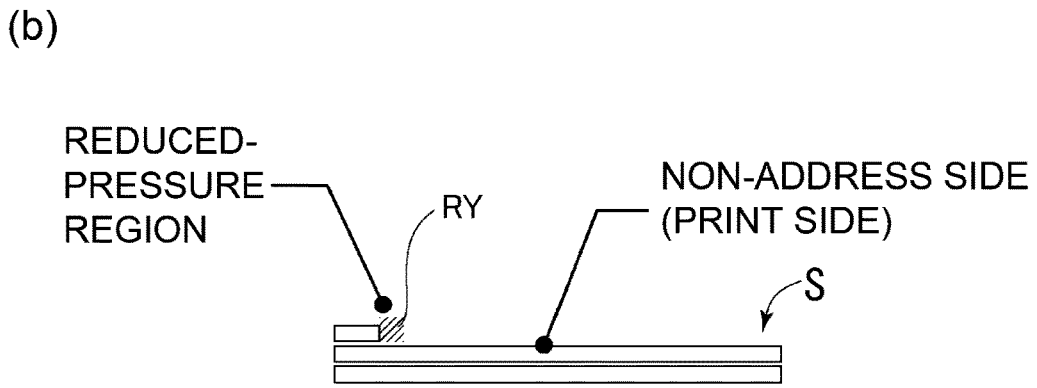

Parts (a) and (b) of FIG. 7 are schematic views showing an envelope of a side pasting type in which part (a) is the schematic view for illustrating superposed portions and part (b) is the schematic view for illustrating depressurization during non-address side fixing.

Figure 8:
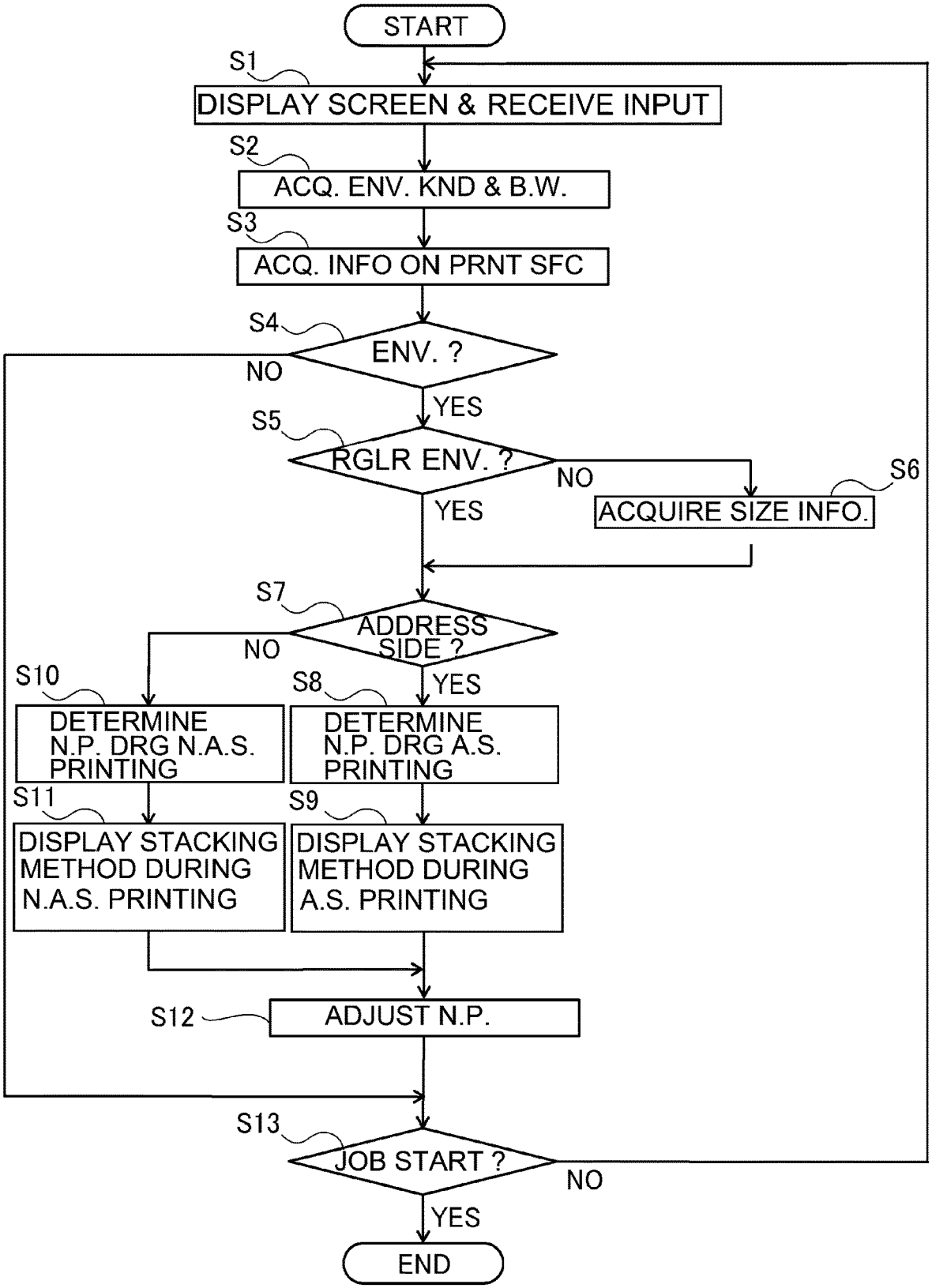

FIG. 8 is a flowchart showing an envelope printing process.

Figure 9:
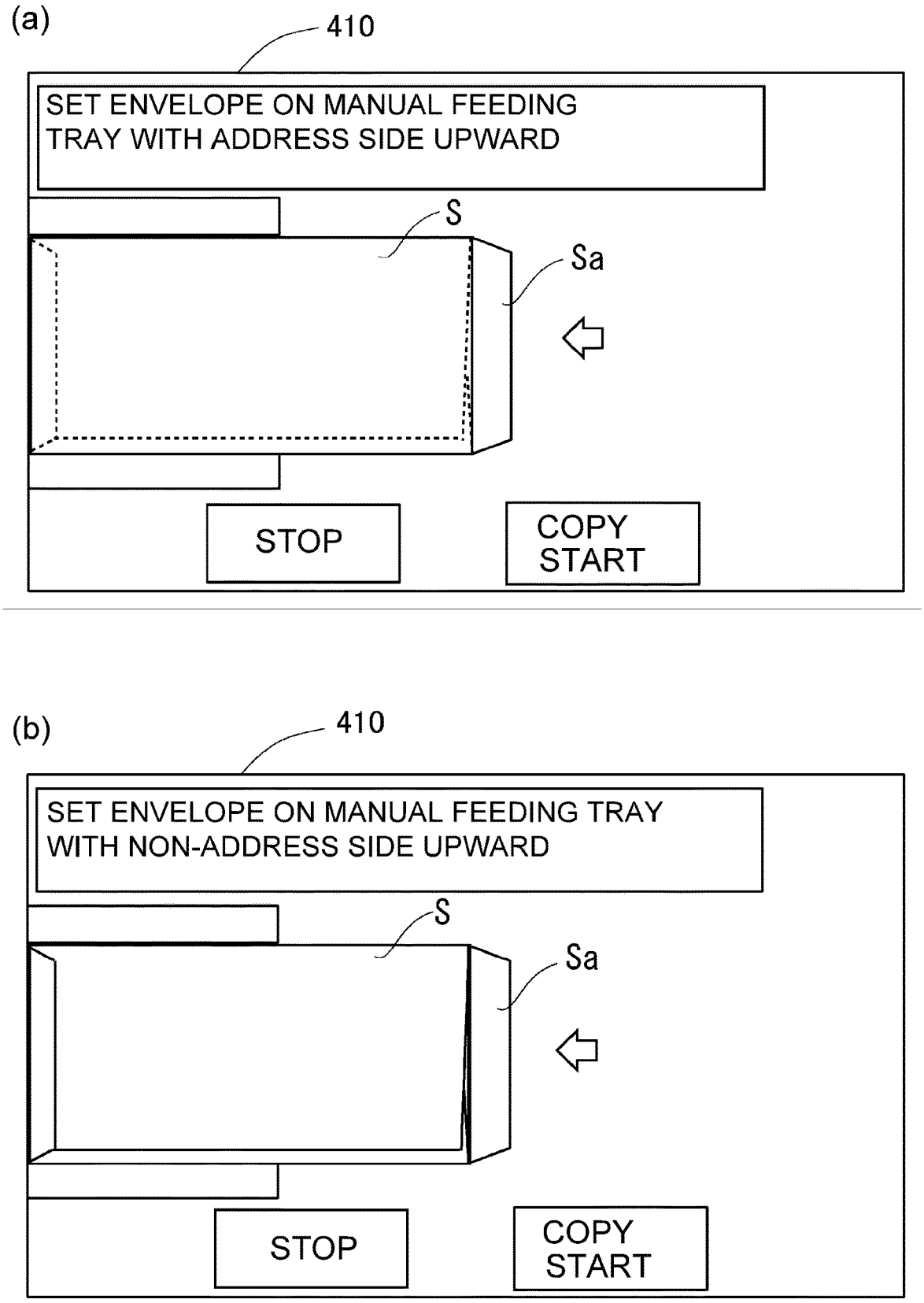

Parts (a) and (b) of FIG. 9 are schematic views each showing a stacking method of an envelope on a manual feeding tray in which part (a) shows the case when an image is printed on an address side and part (b) shows the case when the image is printed on a non-address side.

Figure 10:
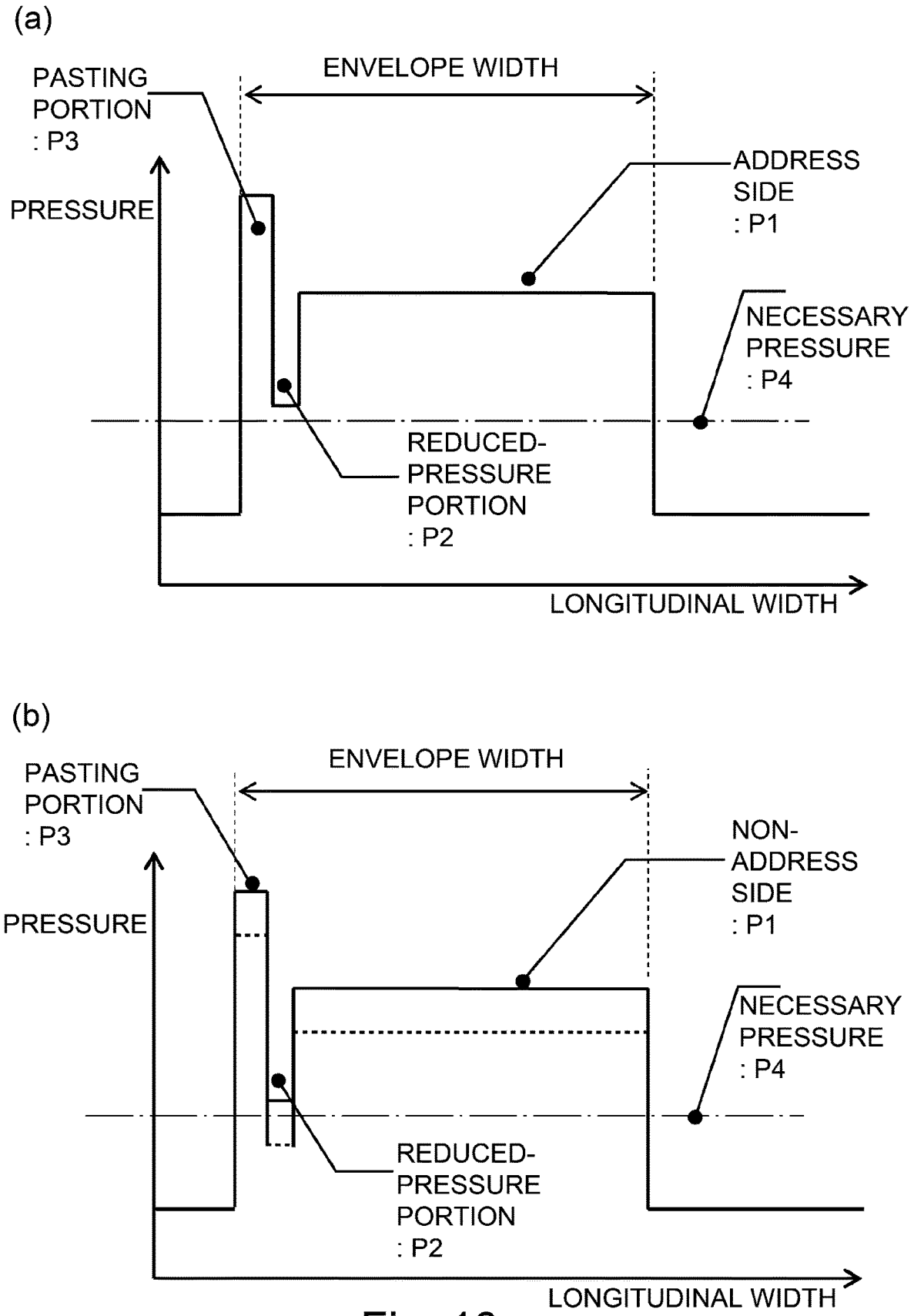

Parts (a) and (b) of FIG. 10 are graphs each showing pressure exerted on an envelope of a side pasting during fixing in which part (a) shows the pressure during address side fixing and part (b) shows the pressure during non-address side fixing.

DESCRIPTION OF EMBODIMENTS

<Image Forming Apparatus>

Figure 1:
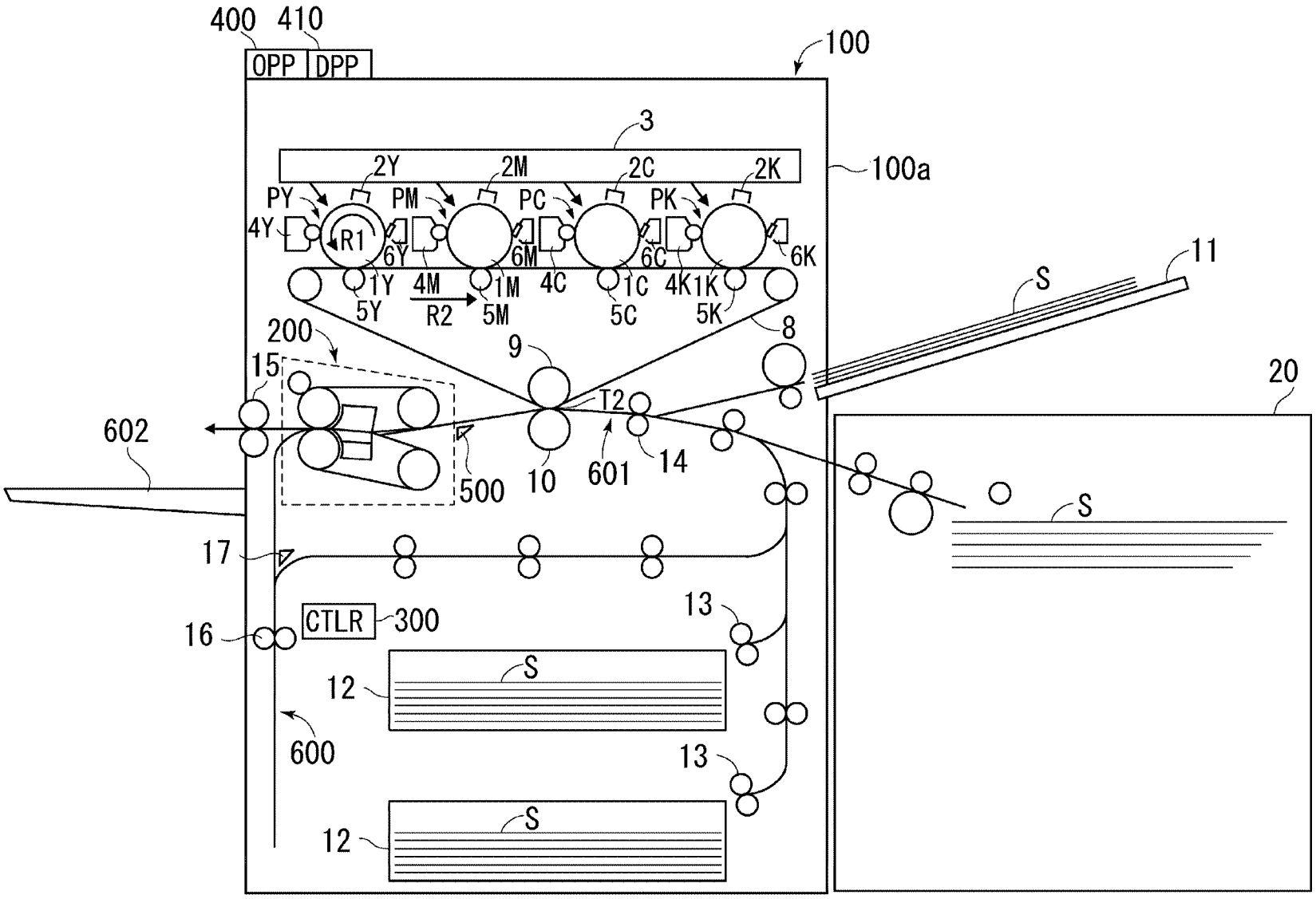
FIG. 1 is a schematic view showing an image forming apparatus according to an embodiment.

An image forming apparatus of an embodiment will be described using FIG. 1. An image forming apparatus 100 shown in FIG. 1 is a tandem full-color printer of an electrophotographic type. The image forming apparatus 100 includes image forming portions PY, PM, PC and PK for forming images of yellow, magenta, cyan and black, respectively. The image forming apparatus 100 forms a toner image on a recording material depending on image data from an original reading device (not shown) connected to an apparatus main assembly 100*a* or from an external device, such as a personal computer, communicatably connected to the apparatus main assembly 100*a*. In this embodiment, the image forming apparatus 100 is capable of forming the toner image on an envelope S which is the recording material.

As shown in FIG. 1, the image forming portions PY, PM, PC and PK are arranged in the apparatus main assembly 100*a* along a movement direction of an intermediary transfer belt 8. The intermediary transfer belt 8 is stretched by a plurality of rollers and is constituted so as to travel in an arrow R2 direction. The intermediary transfer belt 8 carries and feeds toner images which are primary-transferred thereon. A secondary transfer inner roller 9 for stretches the intermediary transfer belt 8. A secondary transfer outer roller 10 is provided at a position opposing, through the intermediary transfer belt 8, the secondary transfer inner roller 9 and constitutes a secondary transfer portion T2 where the toner images are transferred from the intermediary transfer belt 8 onto the envelope S. A fixing device 200 is provided on a side downstream of the secondary transfer portion T2 with respect to a recording material feeding direction.

A cassette 12 in which envelopes S are stacked is located at a lower portion of the image forming apparatus 100. Each of the envelopes S is supplied from the cassette 12 to a feeding passage 601 by a feeding roller pair 13. Thereafter, rotation of a registration roller pair 14 is started in synchronism with the toner images formed on the intermediary transfer belt 8 (described later), whereby the envelope S is fed to the secondary transfer portion T2. Incidentally, the cassette 12 may also be provided in plurality so that envelopes different in size and thickness can be stacked on the plurality of cassettes 12, and in that case, the envelope S is selectively fed from any one of the plurality (two in this embodiment) of cassettes 12. Further, the envelope S is not limited to the envelopes S stacked on the cassettes 12, and the envelope S stacked on a manual feeding tray 11 may also be fed or the envelope S stacked in a stacking device 20 connected to the apparatus main assembly 100*a* may also be fed. Incidentally, in this embodiment, the envelope S on the manual feeding tray 11 or in the stacking device 20 (corresponding to a first stacking portion) is fed to the secondary transfer portion T2 while being kept in a stacked state so that the toner image is formed on an upper surface side. On the other hand, the envelope S in the cassette 12 (corresponding to a second stacking portion) is fed to the secondary transfer potion T2 while being in a stacked state so that the toner image is formed on a lower surface side.

The four image forming portions PY, PM, PC, and PK substantially have the same constitution except that development colors are different from each other. Accordingly, in this embodiment, the image forming portion PY for yellow will be described as a representative of the other image forming portions PM, PC, and PK, and a description of the other image forming portions PM, PC, and PK will be omitted from description. In the image forming portion PY, a photosensitive drum 1Y is provided. The photosensitive drum 1Y is rotationally driven in an arrow R1 direction. At a periphery of the photosensitive drum 1Y, a charging device 2Y, an exposure device 3, a developing device 4Y, a primary transfer roller 5Y and a cleaning device 6Y are provided.

In the case when an image forming operation is started, first, a surface of the rotating photosensitive drum 1Y is electrically charged uniformly by the charging device 2Y. The charging device 2Y is, for example, a corona charger for charging the photosensitive drum 1Y uniformly to a negative dark-portion potential by irradiating the photosensitive drum 1Y with charged particles with corona discharge. Then, the photosensitive drum 1Y is subjected to scanning exposure to laser light, corresponding to image data, emitted from the exposure device 3. As a result, an electrostatic latent image depending on the image data is formed on the surface of the photosensitive drum 1Y. The electrostatic latent image formed on the photosensitive drum 1Y is visualized by toner (developer) accommodated in the developing device 4Y, so that the toner image which is a visible image is formed.

The toner image formed on the photosensitive drum 1Y is primary-transferred onto the intermediary transfer belt 8 at a primary transfer portion formed between the photosensitive drum 1Y and the intermediary transfer belt 8 urged by the primary transfer roller 5Y. At this time, a primary transfer bias is applied to the primary transfer roller 5Y. The toner remaining on the surface of the photosensitive drum 1Y after the primary transfer is removed by the cleaning device 6Y.

Such an operation is successively performed in the respective image forming portions PY to PK for yellow, magenta, cyan and black, respectively, so that four color toner images are superposed on each other. Therefore, in synchronism with toner image formation, the envelope S stacked on the manual feeding tray 11, the cassette 12 or the stacking device 20 is fed to the secondary transfer portion T2 through the feeding passage 601. Then, by applying a secondary transfer bias to the secondary transfer outer roller 10, a full-color toner image formed on the intermediary transfer belt 8 is secondary-transferred onto the envelope S.

Then, the envelope S passed through the secondary transfer roller T2 is supported by a guiding member 500 and is fed toward a fixing device 200. The guiding member 500 guides the envelope S toward the guiding member 500 while supporting the envelope S on a side opposite from a side where the toner image is formed during passing of the envelope S through the secondary transfer portion T2 immediately before guidance of the envelope S by the guiding member 500. In the fixing device 200, as a fixing portion, the toner image is heated and pressed with nip-feeding of the envelope S, so that the toner image is fixed on the envelope S.

<Fixing Device>

Figure 2:
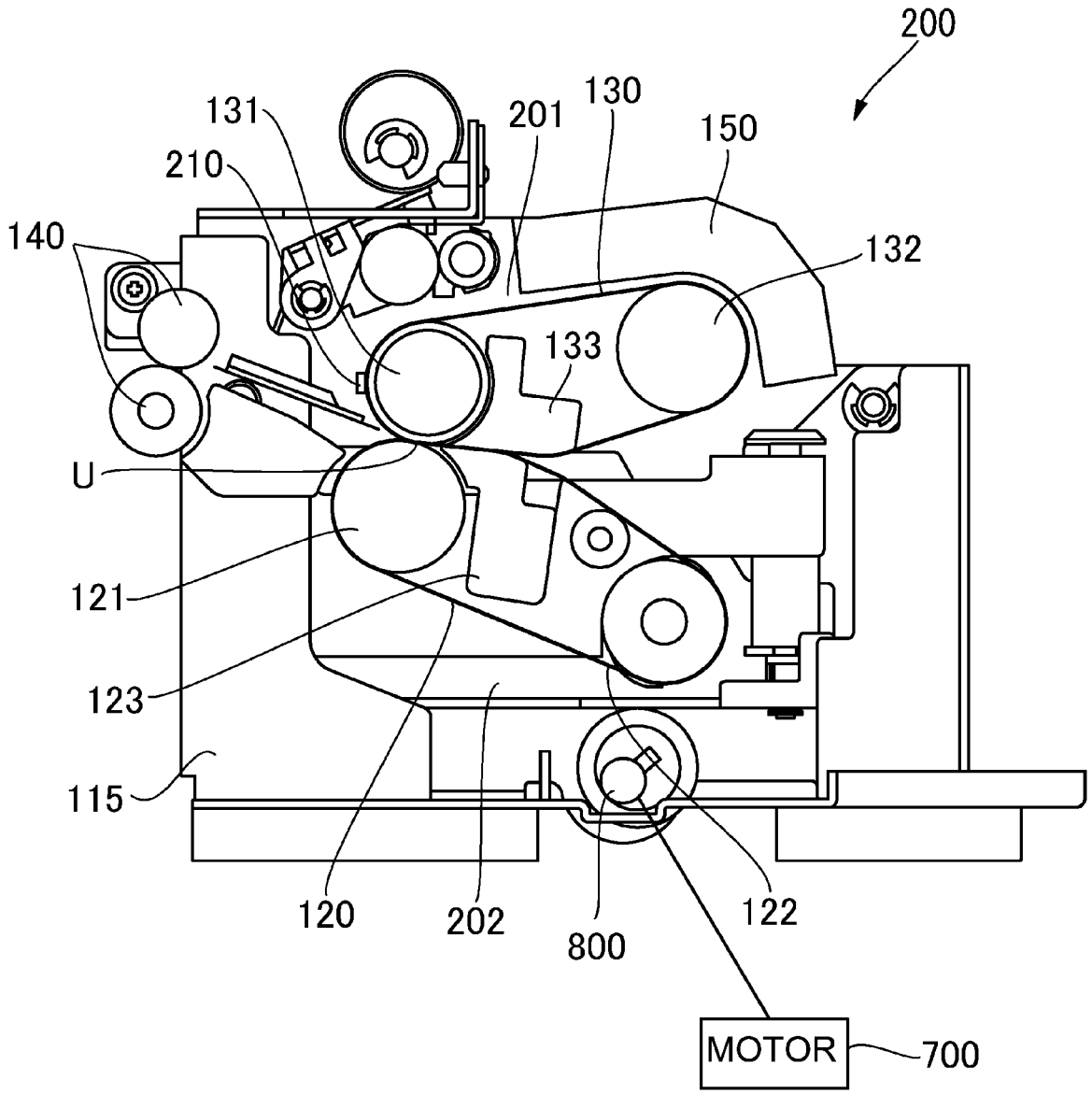
FIG. 2 is a schematic view showing a fixing device.

The fixing device 200 will be described using FIG. 2. The fixing device 200 shown in FIG. 2 is a fixing device of a twin belt type. This fixing device 200 forms a fixing nip U by causing an endless pressing belt 120 assembled with a lower frame 202 to be contacted to an endless fixing belt 130 assembled with an upper frame 201. That is, in the case of this embodiment, the pressing belt 120 corresponds to a nip-forming member. The fixing belt 130 as a fixing member is extended around a driving roller 131 and a tension roller 132, which are shaft-supported by a frame 115, with predetermined tension, and is circulated and rotated by rotation of the driving roller 131. The driving roller 131 has a function of generating pressure at the fixing nip U by supporting an inner surface of the fixing belt 130, and the tension roller 132 has a function of imparting belt tension to the fixing belt 130. Inside the fixing belt 130, a fixing pad 133 formed of stainless steel, for example, is provided. The fixing pad 133 presses the fixing belt 130 toward a pressing pad 123 with predetermined pressure, and thus forms the fixing nip U in combination with the driving roller 131.

In the case of this embodiment, the lower frame 202 is provided so as to be contactable to and separable from the upper frame 201 and is moved by a pressure adjusting mechanism 800 driven by rotation of a pressing motor 700.

When a rotational direction and rotation amount of the pressing motor 700 are changed, the pressure adjusting mechanism 800 is capable of variably changing pressure (pressing force) generating between the pressing belt 120 and the fixing belt 130. Correspondingly thereto, nip pressure (pressure) of a fixing nip U is adjustable to desired pressure. As the pressure adjusting mechanism 800, for example, a mechanism including a pressing cam shaft which includes pressing cams mounted on a base frame at opposite end portions thereof, a pressing gear for transmitting rotation of the pressing motor 700 to the pressing cam shaft, and a pressing spring for urging the lower frame 202 toward the upper frame 201 side, and the like member can be used.

In the fixing device 200, the fixing belt 130 is heated by an induction heating device 150 (for example, an IH heater) through electromagnetic induction heating. The induction heating device 150 is provided so as to provide a predetermined gap between itself and another peripheral surface of the fixing belt 130. The induction heating device 150 includes, although omitted from illustration, for example, an exciting coil prepared by winding electrical wire such as Litz wire, and an outside magnetic core. The exciting coil generates an AC magnetic field (magnetic flux) when an alternating current is applied thereto. The exciting coil generates the AC magnetic field, so that the fixing belt 130 is induction-heated. Further, in order to induction-heat the fixing belt 130 efficiently, the outside magnetic core is formed with a high-permeability member such as ferrite capable of shielding the AC magnetic field is provided so as to cover the exciting coil. Incidentally, the fixing belt 130 is provided with a temperature sensor 210 (e.g., thermistor) as a detecting means for detecting a surface temperature thereof.

The pressing belt 120 is extended around a pressing roller 121 shaft-supported by the lower frame 202 and a tension roller 122 with predetermined tension and is rotated by the rotation of the fixing belt 130. The pressing pad 123 is disposed inside the pressing belt 120 and formed of a silicone rubber, for example. The pressing pad 123 presses the pressing belt 120 toward the fixing pad 133 with predetermined pressure and thus assists formation of the fixing nip U between the pressing belt 120 and the pressing roller 121. The envelope S passed through such a fixing nip U is discharged to an outside of the fixing device 200 by a fixing discharging roller pair 140. Incidentally, in order to form a uniform fixing nip U with respect to the longitudinal direction of the pressing roller 121, the pressing roller 121 may preferably be a roller having a crown shape such that an outer peripheral surface is formed so that a diameter thereof continuously decreases from a central portion toward opposite end portions with respect to a rotational axis direction.

Returning to FIG. 1, the image forming apparatus 100 is capable of printing images on both sides (surfaces) of the envelope S. In the case of one-side printing, the envelope, S on which the toner image is fixed on one side thereof, is discharged by a discharging roller pair 15 on a discharge tray 602 provided outside the apparatus main assembly 100*a*. On the other hand, in the case of double-side printing, the envelope S, on which the toner image is fixed on a first (one) side, is fed by a normally rotating feeding roller pair 16 toward a double-side feeding passage 600 in order to form a toner image on a second side subsequently to fixing the toner image on the first side. Then, the feeding roller pair 16 is reversely rotated when a trailing end of the envelope S with respect to a recording material (envelope) feeding direction reaches a switching portion 17. Leading and trailing ends of the envelope S are swapped in the double-side feeding passage 600 by the reverse rotation of the feeding roller pair 16, and the envelope S is fed again along the feeding passage 601 toward the registration roller pair 14 (so-called, switch-back feeding). In this case, the envelope S to be fed again along the feeding passage 601 is switched (reversed) between the first side and the second side thereof so that the other side (the second side opposite from the first side) where the toner image is not fixed at the secondary transfer portion T2 faces toward the intermediary transfer belt 8 side. Thereafter, the envelope S is subjected to the process similar to the process in the case of the one-side printing, and thus the toner image is fixed on the second side thereof, and then is discharged by the discharging roller pair 15 on the discharge tray 602 disposed outside the apparatus main assembly 100*a*. Incidentally, a portion constituted by the double-side feeding passage 600, the discharging roller pair 15 and the switching portion 17 is an example of a feeding mechanism for automatically reversing and feeding the envelope S.

<Controller>

Figure 3:
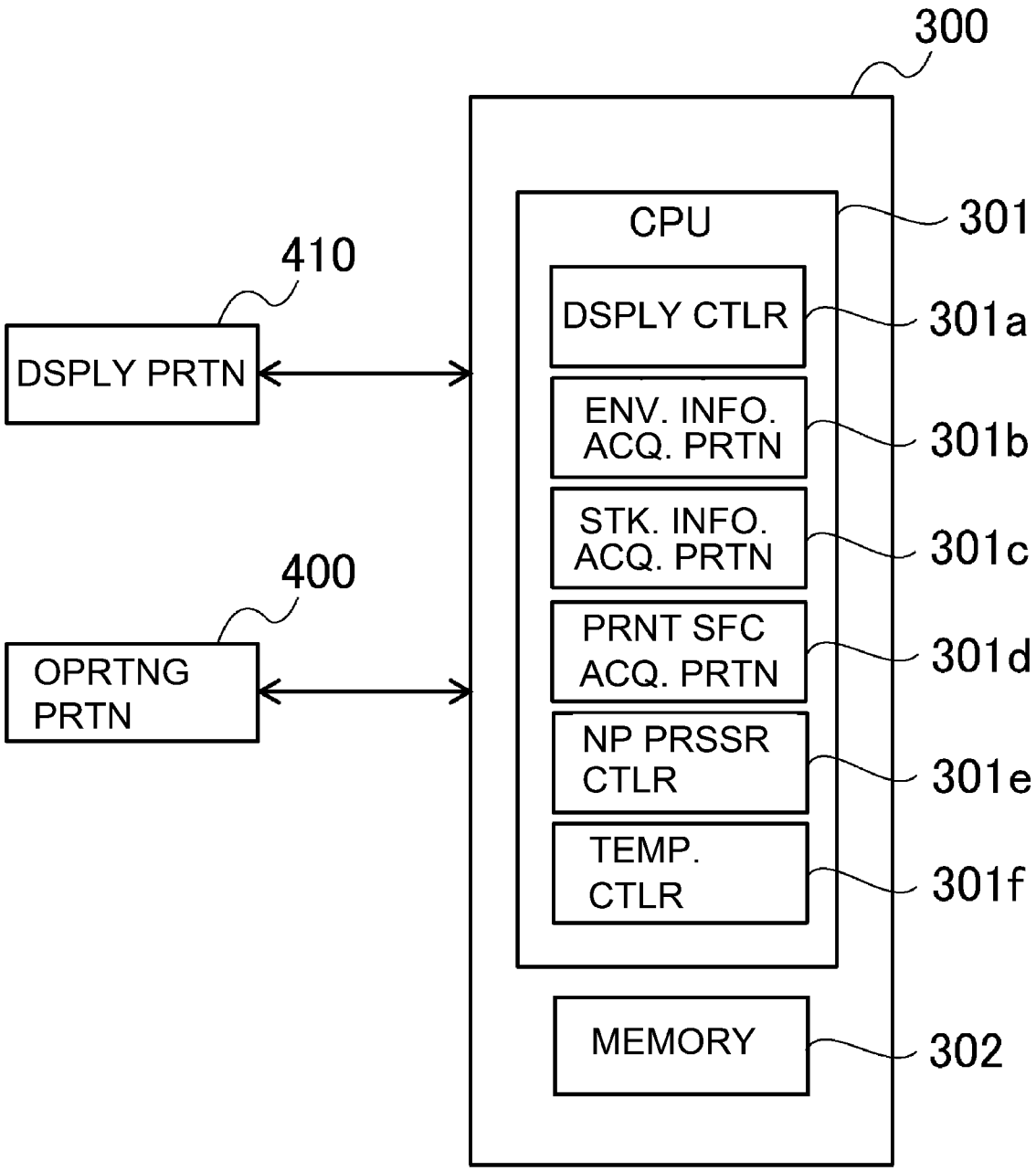
FIG. 3 is a control block diagram for illustrating a controller.

As shown in FIG. 1, the image forming apparatus 100 of this embodiment includes a controller 300 as a control means. The controller 300 will be described using FIG. 3. As shown in FIG. 3, the controller 300 includes a CPU 301 (central processing unit) and a memory 302 such as a ROM (read only memory) or a RAM (random access memory). In the memory 302, for example, various programs such as a printing program (FIG. 8 described later) and an image forming job, and various data such as envelope information, stacking portion information or a control table (Table 1, below) which are described later, and the like are capable of being stored. The CPU 301 is capable of executing the various programs stored in the memory 302. Incidentally, the memory 302 is also capable of temporarily storing a calculation process result with execution of the various programs.

In the case of this embodiment, the CPU 301 is capable of carrying out an operation of the image forming apparatus 100 regarding printing on a recording material such as the envelope S by executing the printing program in advance of execution of the image forming job. Incidentally, the printing program is not limited to the form of a software program, but may also be executable in the form of a micro program processed by a DSP (digital signal processor), for example. That is, as regards the CPU 301, one for carrying out various pieces of control such as an image forming operation by executing a control program such as the image forming job may also be used in combination, but the CPU 301 is not limited thereto. A CPU prepared exclusively for executing the printing program may also be used.

To this CPU 301, an operating portion 400 and the display portion 410 are connected via communication busses (for example, data and address busses). The operating portion 400 is, for example, an operating panel, an external terminal or the like for receiving an execution start operation, by a user, of the various programs such as the image forming job and receiving various data inputting operations by the user and the like operation. The operating portion 400 includes, as described later (FIG. 4), various operating elements such as operating keys and operating buttons through which the operating portion 400 receives user's input. The display portion 410 is capable of appropriately displaying various screens such as an input screen (FIG. 5) for inputting various data relating to the envelope S on which the image is printed. In the case of this embodiment, the display portion 410 is a display of a so-called touch panel type in which various virtual operating elements are displayed and input of various data by the user depending on a touch operation to the virtual operating elements by the user. Incidentally, the display portion 410 is not limited to the display provided to the apparatus main assembly 100*a*, but may also be, for example, an external display connected to the apparatus main assembly 100*a* or a display of an external terminal such as a personal computer. Further, the display portion 410 may also be connected to the image forming apparatus 100 through cable (wire) connection or wireless connection if the display portion 410 is capable of communicating with the image forming apparatus 100.

<Operating Portion>

Figure 4:
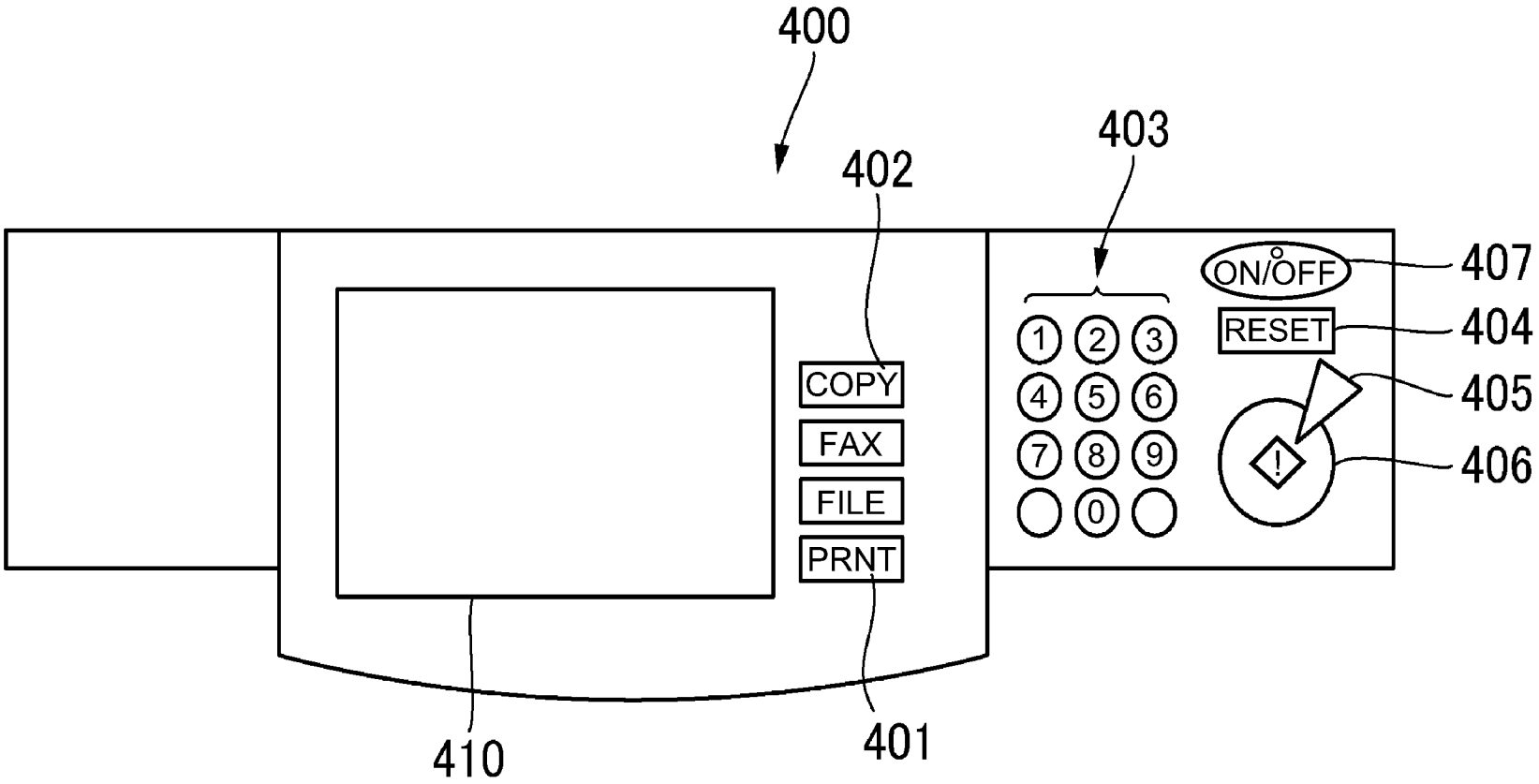
FIG. 4 is a schematic view showing an operating portion.

FIG. 4 shows an example of the operating portion 400. As shown in FIG. 4, the operating portion 400 is provided with various operating elements such as a printer key 401, a copy mode key 402, a numeric keypad 403, a reset key 404, a stop key 405, a start key 406, and a power (on/off) switch 407. The printer key 401 is used for inputting various data relating to normal printing. The copy mode key 402 is used for inputting various data relating to copy printing in the case when the image forming apparatus 100 is used as a copying machine (copy mode). In the case when the printer key 401 or the copy mode key 402 are operated, for example, an input screen for inputting the various data is displayed at the display portion 410. The numeric keypad 403 is used for inputting information on a numerical value such as print number, for example. The reset key 404 is used for resetting inputted various data by operation of the respective keys, to initial values. The stop key 405 is used for forcedly stopping the image forming job during execution, for example. The start key 406 is used for providing on instruction to start the image forming job including a reading operation of an original image during an operation in a copy mode. The power switch 407 is used for turning on and off a power source of the image forming apparatus 100.

<Input Screen>

Figure 5:
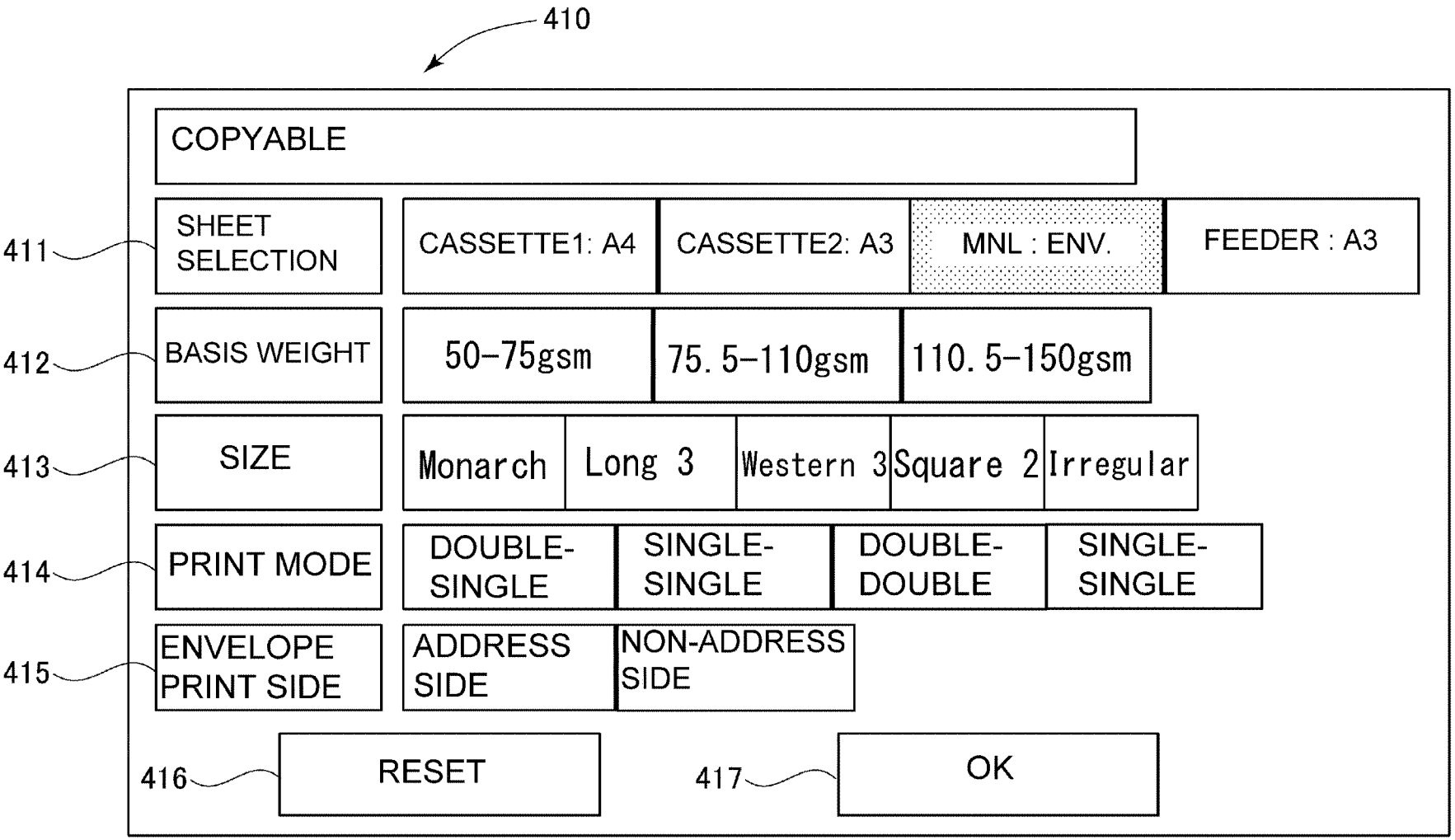
FIG. 5 is a schematic view showing an input screen.

FIG. 5 shows an example of an input screen displayed at the display portion 410 and is case when the image forming apparatus 100 is used as the copying machine (copy mode). In order to indicate the copy mode, on the input screen shown in FIG. 5, "COPYABLE" is displayed. On this input screen, as the virtual operating elements, a sheet selection key 411, a basis weight selection key 412, a size selection key 413, a print mode key 414, an envelope printing side selection key 415, a reset (setting release) key 416, an OK key 417 are displayed. The user is capable of selectively inputting the various data relating to the printing operation by using these virtual operating elements displayed on the display portion 410. That is, the display portion 410 not only functions as a display means but also is capable of functioning as an input means by displaying the virtual operating elements on a screen. Each time the virtual operating element is operated by the user, it is highlighted. As a result, the user can know that selection of information on display contents associated with the operated virtual operating element was made. Incidentally, the virtual operating elements shown in FIG. 5 are examples and are not limited thereto.

The sheet selection key 411 is used for inputting one of the cassette 12, the manual feeding tray 11, and the stacking device 20. Any one of the cassette 12, the manual feeding tray 11, and the stacking device 20 (hereafter, these are also referred to as stacking portions) inputted by the sheet selection key 411 is stored in the memory 302 (FIG. 3). In this example, the case when "MANUAL FEEDING TRAY: ENVELOPE" is selected for stacking the envelope S on the manual feeding tray 11 and for printing the image on the surface is shown.

The basis weight selection key 412 is used for inputting a basis weight of the envelope S. The size selection key 413 is used for inputting a size (kind) of the envelope S stacked on the stacking portion inputted by the sheet selection key 411. In this example, as the size of the envelope S stacked on the manual feeding tray 11, it is possible to input either one of "Monarch, Long 3, Western 3, Square 2, Irregular". When "Irregular" is inputted as the size of the envelope S, the user may input an arbitrary size by using the numeric keypad 403 (FIG. 4) or the like. The thus-selected or inputted size (kind) of the envelope S is stored as envelope information in the memory 302. In the case of this embodiment, the envelope information is capable of including information on a basis weight of the envelope S, in addition to the kind of the envelope S subjected to the image formation.

The print mode key 414 is used for inputting either one of a one (single) side printing mode in which the image is printed on only one (single) side of the recording material and a double-side printing mode in which the images are printed on both sides of the recording material. The user is capable of selecting the one-side printing mode in which the images on both sides of an original are printed on one side of the recording material ("DOUBLE-SINGLE") or in which the image on one side of the original is printed on one side of the recording material ("SINGLE-SINGLE") and the double-side printing mode in which the image on one side of the original is printed on both sides of the recording material ("SINGLE-DOUBLE") or in which the images on both sides of the original are printed on both sides of the recording material ("DOUBLE-DOUBLE"). The envelope printing side selection key 415 is used for the user to select whether the image is printed on the address side (flap-formed side, i.e., the front side) of the envelope S or on the non-address side (the side where the flap is not formed, i.e., the back side) of the envelope S. Incidentally, in the case when the double-side printing of the images on the both sides of the envelope S is carried out, the image may be printed on the side selected by the envelope printing side selection key 415 first or printing may also be carried out in a manner such that the envelope printing side selection key 415 is not displayed and the image is printed first on either of the address side and the non-address side of the envelope S. The reset key 416 is used for resetting (releasing) the information inputted by the operation of each of the above-described keys. The OK key 417 is used for determining the information inputted by the operation of each of above-described keys.

Returning to FIG. 3, the CPU 301 acquires various data inputted through the operating portion 400 and the display portion 410 and causes the memory 302 to store the various data. Then, for example, depending on an actuating operation such as turning-on of the power source (main switch) of the image forming apparatus 100, the CPU 301 reads the printing program (FIG. 8) from the memory 302 and displays the control program. By executing the printing program, the controller 300 functions as a display controller 301*a*, an envelope information acquiring portion 301*b*, a stacking portion information acquiring portion 301*c*, a printing side acquiring portion 301*d*, a nip pressure controller 301*e*, and a temperature controller 301*f*.

The display controller 301*a* controls the display at the display portion 410. As part of controlling the display portion 410, the display controller 301*a* not only causes the display portion 410 to display the above-described input screens but also a stacking method of the envelope S on the cassettes 12, the manual feeding tray 11, and the stacking device 20. The envelope information acquiring portion 301*b* acquires, for example, envelope information, such as the size of the envelope S, inputted at the operating portion 400 or the display portion 410 and causes the memory 302 to store the enter information. The stacking portion information acquiring portion 301*c* acquires the stacking portion information of the cassettes 12, the manual feeding tray 11, or the stacking device 20, on which the envelope S inputted at the display portion 410 is stacked and causes the memory 302 to store the stacking portion information.

The printing side acquiring portion 301*d* acquires information (address side or non-address side) on the printing side of the envelope S selected depending on an operation of the envelope printing side selection key 415 and causes the memory 302 to store the information. The nip pressure controller 301*e* controls, as described later (FIG. 8), on the basis of the acquired information on the printing surface of the envelope S, the pressure adjusting mechanism 800 by changing the rotational direction and the rotation amount of the pressing motor 700. The temperature controller 301*f* refers to a detection result of the temperature sensor 210 (FIG. 2), and, as described above, controls the induction heating device 150 so that the surface temperature of the fixing belt 130 is set at a predetermined temperature depending on the information of the basis weight of the envelope S.

In the conventional constitution, as described above, when the toner image is fixed on the envelope S, fixing is carried out with the same nip pressure between the address side and the non-address side. Therefore, there is a liability that a stepped portion trace (envelope crease) occurs on the envelope S when fixing the toner image on the address side of the envelope S or that improper fixing of the toner image when fixing the toner image on the non-address side of the envelope S. This is because the envelope S is formed in a bag shape and a thickness of the envelope is different between a portion where paper (sheet) and paper (sheet) are pasted to each other and another portion (these portions are referred to as a pasted portion hereafter) and therefore pressures actually exerted on the envelope S at the pasted portion when the envelope passes through the fixing nip U can be different from each other.

Figure 6:
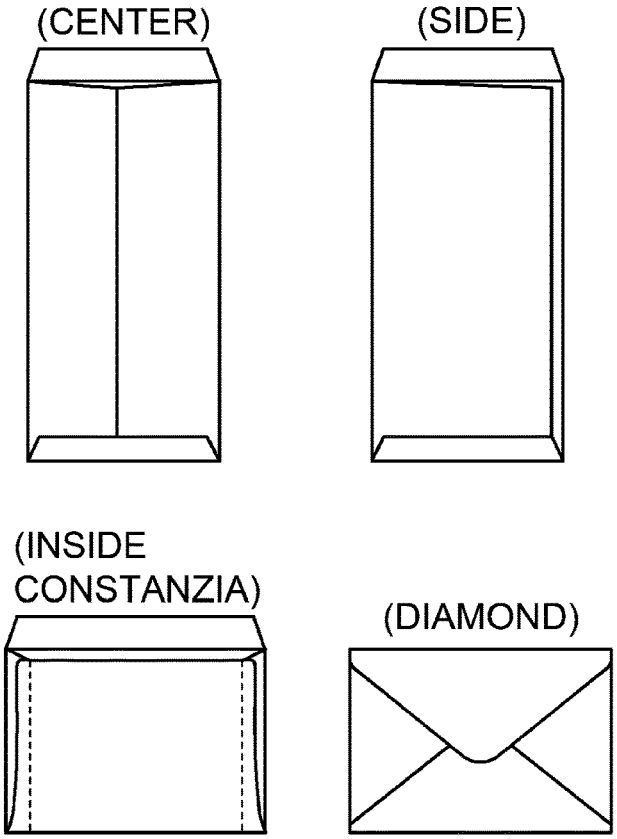
FIG. 6 includes a table and schematic views for illustrating envelopes.

That is, the envelope S is prepared by pasting paper folded in a cylindrical shape to a part of the paper. Various kinds of envelops exists even in standardized sizes. In FIG. 6, short-side lengths (widthwise length) and pasting shapes of representative envelopes are shown. As shown in FIG. 6, envelopes S having short-side lengths from 98 mm to 240 mm are shown representing envelopes distributed in Japan or foreign countries. Further, even when the envelopes S are of the same type, the envelops may be folded in different ways. For example, in the case of Japanese-style envelopes, "center pasting" including a pasted portion where parts of the paper are pasted to each other at a central portion with respect to the widthwise direction and "side pasting" including the pasted portion at one end portion with respect to the widthwise direction exist. In the case of Western-style envelopes, "(Inside/Outside) Constanzia wallet pasting" including the pasted portion at opposite end portions with respect to the widthwise direction and "diamond flap pasting" including a triangular flap and the pasted portion having an oblique shape exist.

In the case when the toner images are fixed on these various envelopes S, by using nip pressure exclusively for envelopes lower than the nip pressure for the envelope of plain paper, an envelope crease which is liable to occur during address side fixing is suppressed. However, in such a case, in the conventional constitution, improper fixing occurred during non-address side fixing. This is because the actual pressure exerted on the pasted portion in the fixing nip U may be insufficient (so-called depressurization) depending on the shapes and basis weights of the envelopes S. The depressurization during non-address side fixing will be described using, for example, the envelope S with side pasting with reference to parts (a) and (b) of FIG. 7.

As shown in part (a) of FIG. 7, the envelope S, for example, "Long 3" with side pasting, includes a pasted portion HA1 at an end portion with respect to a direction (widthwise direction) crossing a feeding direction of the envelope S. In such an envelope S, improper fixing may occur at a boundary portion RY (hatched portion in FIG. 7) between superposed portions of 3 sheets and 2 sheets. As shown in part (b) of FIG. 7, a stepped portion, corresponding to one sheet of paper, occurs at this boundary portion, and the fixing belt 130 (FIG. 2) cannot follow this portion resulting in partially insufficient pressure and a reduced fixing property. Further, the crown shape of the pressing roller 121 is also one of the factors. That is, in the case of the crown shape, there is a tendency that in the fixing nip U pressure is more likely lower at a central portion than at opposite end portions with respect to a longitudinal direction of the pressing roller 121. Thus, the pressure at the opposite end portions is more likely to become insufficient, so that the improper fixing may occur at the boundary portion of the envelope S.

Therefore, in view of this point, in this embodiment, the nip pressure is made different between fixing the address side of the envelope S and fixing the non-address side of the envelope S so that the pressure actually exerted on the envelope S at the portion different in thickness is an optimum pressure for fixing when the envelope S passes through the fixing nip U. This will be described below.

<Printing Process>

The printing process in this embodiment will be described using FIG. 8 with reference to FIGS. 3 to 5. The printing process in this embodiment is started by the controller 300, for example, when the printer key 401 or the copy mode key 402 of the operating portion 400 is operated by the user, and is ended in response to an operation of the start key 406 of the operating portion 400, i.e., a start of an image forming job.

The controller 300 causes the display portion 410 to display the above-described input screen (FIG. 5), or the like, and receives user input through the displayed input screen (S1). In response to the user input, the controller 300 acquires envelope information including information on the kind and the basis weight of the envelope S by the envelope information acquiring portion 301*b* (S2). Further, the stacking portion information acquiring portion 301*c* acquires stacking portion information. Further, in the controller 300, the printing side acquiring portion 301*d* acquires information (whether the printing side is the address side or the non-address side) on the printing side of the envelope S (S3). Further, the controller 300 determines whether or not the recording material subjected to printing is the envelope (S4). In the case when the recording material is not the envelope S (NO of S4), the controller 300 causes the process to jump to step S13. On the other hand, in the case when the recording material is the envelope S (YES of S4), the controller 300 determines whether or not the envelope S subjected to the printing is a regular envelope (S5). In the case when the envelope S is not the regular envelope (NO of S5), the controller 300 acquires the size (inputted size information) of the envelope S inputted by an operation of the numeric keypad 403 (S6), the inputted size information acquired is stored as partial data of the envelope information in the memory 302.

On the basis of the acquired information on the printing side of the envelope S, the controller 300 determines which one of the address side printing and the non-address side printing should be carried out (S7). In the case when the address side printing is carried out (YES of S7), the nip pressure controller 301*e* sets the nip pressure during address side fixing on the basis of the information on the printing side of the envelope S (S8). Further, the pasted portion controller 301*a* causes the display portion 410 to display a "stacking method during address side printing" (part (a) of FIG. 9 described later) including an envelope image (S9). On the other hand, in the case when the non-address side printing is carried out (NO of S7), the nip pressure controller 301*e* sets the nip pressure during non-address side fixing on the basis of the information on the printing side of the envelope S (S10). Further, the display controller 301*a* causes the display portion 410 to display a "stacking method during non-address side printing" (part (b) of FIG. 9 described later) including an envelope image (S11).

<Display Example of Envelope Stacking Method>

Here, the "stacking method during address side printing" and the "stacking method during non-address side printing" displayed at the display portion 410 will be described using parts (a) and (b) of FIG. 9.

Here, an envelope S with a flap Sa on the short side (for example, Square 2) is stacked on the manual feeding tray 11 for example. The "stacking method during address side printing" is shown in part (a) of FIG. 9, and the "stacking method during non-address side printing" is shown in part (b) of FIG. 9. In this embodiment, the stacking method of the envelope S is displayed at the display portion 410 by character information illustrating the envelope stacking method with characters and by image information represented by an envelope image including an orientation of the flap Sa of the envelope S and the front and back of the envelope S. Incidentally, also in the case of the envelope S with the flap Sa on the long side (for example, Western 3), similar display may also be employed. Further, in the case of the envelope S with the flap Sa on the long side, display such that the envelope S is stacked along a direction in which the flap Sa crosses a feeding direction of the envelope S may also be made.

As shown in part (a) of FIG. 9, in the case when printing of the image on the address side of the envelope S stacked on the manual feeding tray 11 is selected, the stacking method of the envelope S is displayed so that the address side (the side where the flap Sa is formed) faces upward. On the other hand, as shown in part (b) of FIG. 9, in the case when printing of the image on the non-address side of the envelope S stacked on the manual feeding tray 11 is selected, the stacking method of the envelope S is displayed so that the non-address side (the side where the flap Sa is not formed) faces upward. Incidentally, in this case, the example in which the envelope image is displayed so that the closed short side (non-flap side) with no flap Sa is on the leading end side with respect to the feeding direction was described, but the envelope image may also be displayed so that the non-flap surface is on the trailing end side with respect to the feeding direction.

Incidentally, in the case when printing of the image on the address side of the envelope S stacked in the stacking device 20 is selected, the same display as the display of the "stacking method during address side printing" shown in part (a) of FIG. 9, i.e., the stacking method in which the address side of the envelope S is the upper surface side is displayed. Further, in the case when printing of the image on the non-address side of the envelope S stacked in the stacking device 20 is selected, the same display as the display of the "stacking method during non-address side printing" shown in part (b) of FIG. 9, i.e., the stacking method in which the non-address side of the envelope S is the upper surface side is displayed. On the other hand, in the case when printing of the image on the address side of the envelope S stacked in the cassette 12 is selected, the stacking method in which the non-address side of the envelope S is the upper surface side, i.e., the stacking method shown in part (b) of FIG. 9 is displayed. However, as character information, "SET ENVELOPE WITH ADDRESS SIDE UPWARD" is displayed. Further, in the case when printing of the image on the non-address side of the envelope S stacked in the cassette 12 is selected, although illustration is omitted, the stacking method in which the address side of the envelope S is the upper surface side, i.e., the stacking method shown in part (a) of FIG. 9 is displayed. However, as character information, "SET ENVELOPE WITH NON-ADDRESS SIDE UPWARD". This is because as described above, the envelope S on the manual feeding tray 11 or in the stacking device 20 is fed to the secondary transfer portion T2 in a state in which the front and back of the envelope S is kept in the stacked state, but the envelope S in the cassette 12 is fed to the secondary transfer in a state in which the front and back of the envelope S is in a state reverse to the stacked state. The display of the stacking method which can vary depending on the above-described stacking portion is made on the basis of the stacking portion information acquired by the stacking portion information acquiring portion 301*c*.

Further, in the case when the stacking method is displayed so that the flap Sa extends along the direction crossing the feeding direction of the envelope S, as shown in parts (a) and (b) of FIG. 9, the stacking method is displayed so that the short side (flap side) on which the flap Sa exists is the trailing end side with respect to the feeding direction, is preferred as such an orientation prevents an envelope crease from occurring.

Returning to description of FIG. 8, the controller 300 controls the pressing motor 700 in order to adjust the pressure to the nip pressure set by the nip pressure controller 301*e* (S12). Then, the controller 300 determines whether or not a start of the image forming job is instructed by an operation of the start key 406 by the user (S13). In the case when the start of the image forming job is not instructed (NO of S13), the controller 300 repeats processes of S1 to S12 described above. In the case when the start of the image forming job is instructed (YES of S13), the controller 300 ends the printing process.

In the controller 300 (specifically in the nip pressure controller 301*e*), the nip pressure of the fixing nip U is set in accordance with a control table (data) shown in Table 1 below. However, in the Table 1, the nip pressure of the fixing nip U is represented by a rotation amount (pls) from a reference position of the pressing motor 700. As can be understood from the Table 1, in order to ensure the nip pressure necessary during address side fixing, there is a need to change the rotation amount of the pressing motor 700 in a range of 200-600 (pls). On the other hand, in order to ensure the nip pressure necessary during non-address side fixing, there is a need to change the rotation amount of the pressing motor 700 in a range of 400-800 (pls). In the case of this embodiment, the nip pressure is adjusted to first nip pressure during fixing of the toner image on the address side of the envelope and is adjusted to second nip pressure higher than the first nip pressure during fixing of the toner image on the non-address side of the envelope. As an example, the nip pressure during address side fixing is 100 (N) or more and 500 (N) or less, preferably 150 (N) or more and 450 (N) or less. The nip pressure during non-address side fixing is 250 (N) or more and 650 (N) or less, preferably be 300 (N) or more and 600 (N) or less. Further, the rotation amount of the pressing motor 700 is set so that the nip pressure during non-address side fixing is higher than the nip pressure during address side fixing. For example, the nip pressure may preferably be set at a value optimum for fixing the toner image on the address side and the non-address side in consideration of the pressure corresponding to the depressurization. Incidentally, the control table (data) shown in the Table 1 may also be stored in the memory 302 for each of the kinds of the envelopes S. In that case, the controller 300 is capable of referring to the corresponding control table in accordance with the envelope information.

TABLE 1

| EW/BW*1 | 50-75 gsm | 75.5-110 gsm | 110.5-150 gsm |
|---|---|---|---|
| ASNP*2 | 600 pls | 400 pls | 200 pls |
| NASNP*3 | 800 pls | 600 pls | 400 pls |
| FT*4 | 180° C. | 190° C. | 195° C. |

*1"EW/BW" is an envelope width, i.e., the basis weight of the envelope.
*2"ASNP" is the address side nip pressure.
*3"NASNP" is the non-address side nip pressure.
*4"FT" is the fixing temperature.

Incidentally, there are various kinds of base paper constituting the envelopes S and basis weights of the envelopes S. As the kinds of the base paper, for example, craft paper, Kent paper, quality paper, cotton paper, and the like are used. Further, when the craft paper has a wide variety of basis weights ranging from 50 gsm to 120 gsm. Therefore, in this embodiment, as shown in the Table 1, the rotation amounts of the pressing motor 700 are set in the control table so that the nip pressure during address side fixing and the nip pressure during non-address side fixing are different from those depending on the basis weight of the envelope S. This is because when the basis weight of the envelope S increases, the pressure actually exerted on the envelope S in the fixing nip U is capable of becoming high correspondingly to the thickness of the envelope S. In this embodiment, the nip pressure (first nip pressure) during address side fixing and the nip pressure (second nip pressure) during non-address side fixing in the case when the basis weight of the envelope S is a first basis weight is made higher than those in the case when the basis weight of the envelope S is a second basis weight larger than the first basis weight. That is, with a decreasing basis weight of the envelope S, compared with the case when the basis weight is large, the rotation amount of the pressing motor 700 is set so that both the nip pressure (first nip pressure) during address side fixing and the nip pressure (second nip pressure) during non-address side fixing are high.

Further, in the control table, as shown in Table 1, the surface temperature of the fixing belt 130 is set for each of the basis weights of the envelopes S. This is because when the basis weight of the envelope S increases, a thermal quantity necessary to fix the toner image in the fixing nip U increases correspondingly to the thickness of the envelope S. Therefore, in this embodiment, the surface temperature (fixing temperature) of the fixing belt 130 is set so that the surface temperature is a first temperature when the basis weight of the envelope S is a first basis weight and so that the surface temperature is a second temperature higher than the first temperature when the basis weight of the envelope S is the second basis weight larger than the first basis weight. The controller 300 controls the induction heating device 150 in accordance with the control table and thus is capable of adjusting the surface temperature of the fixing belt 130 to a set temperature.

As described above, in this embodiment, the nip pressure is made different between fixing the toner image on the address side of the envelope S and fixing the toner image on the non-address side of the envelope S by making reference to the control table. The pressure exerted on the envelope S in the fixing nip U will be described with reference to parts (a) and (b) of FIG. 10 using the envelope S (Long 3) with side pasting as an example. Part (a) of FIG. 10 shows the pressure exerted on the envelope S in the fixing nip U during address side fixing, and part (b) of FIG. 10 shows the pressure exerted on the envelope S in the fixing nip U during non-address side fixing.

In part (a) and (b) of FIG. 10, the abscissa represents a longitudinal width (longitudinal length) of the fixing belt 130, and the ordinate represents the pressure exerted on the envelope S. Of the longitudinal width, a portion where the envelope S is nipped is an envelope width, and a pressure distribution depending on the shape of the envelope S is shown. In the figures, the pressure exerted on the address side is "P1", the pressure exerted on the boundary portion RY (part (a) of FIG. 7) is "PZ", the pressure exerted on the pasted portion HA1 (part (a) of FIG. 7) is "P3", and a minimum necessary pressure for fixing is "P4".

As shown in part (a) of FIG. 10, when the envelope S passes through the fixing nip U during address side fixing, the pressure P3 exerted on the pasted portion HA' becomes high. On the other hand, at the boundary portion RY, the depressurization occurs due to the stepped portion corresponding to one sheet of paper, and therefore, the pressure P2 exerted on the boundary portion RY is lower. Then, the pressure P1 exerted on the address side, which is the printing side, is higher than the pressure P2 since there is no stepped portion and the address side has a uniform surface. During fixing of the toner image on the address side of the envelope S, such a pressure distribution occurs, and therefore, the pressure P2 exerted on the boundary portion RY is lower than the pressure P4 necessary for fixing in some instances, and in that case, depressurization occurs at the boundary portion RY and can cause the improper fixing. Therefore, in this embodiment, in order to meet such a situation, the nip pressure is set so that the nip pressure P1 exerted on the boundary portion RY during address side fixing is higher than the pressure P4 necessary for fixing. However, when the nip pressure is excessively high, the pressure exerted on the pasted portion HA1 becomes excessively high, so that there is an increasing possibility that the stepped portion (trace) occurs on the envelope S. Therefore, in this embodiment, in consideration of damage on the envelope S, it is desirable that the nip pressure is set so that the pressure P2 exerted on the boundary portion RY is substantially equal to the pressure P4 necessary for fixing.

On the other hand, as shown in part (b) of FIG. 10, when the same nip pressure is set during non-address side fixing of the toner image on the envelope S as the nip pressure during address side fixing of the toner image on the envelope S, there is a liability that the pressure P2 exerted on the boundary portion RY is below the pressure P4 necessary for fixing (broken line in the figure) due to the depressurization occurring at the boundary portion RY where the stepped portion is large. That is, even for the same envelope S, during non-address side fixing, the pressure P2 exerted on the boundary portion RY is less than the pressure P4 necessary for fixing in some instances. In such a case, improper fixing can occur at the boundary portion RY. Therefore, during non-address side fixing, there is a need to ensure fixing property of the toner image by making the nip pressure higher than the nip pressure during address side fixing. In the case of this embodiment, the nip pressure during non-address side fixing is set so as to be higher than the nip pressure during address side fixing, and therefore, as shown in part (b) of FIG. 10, the pressure exerted on the envelope S exceeds the pressure P4 necessary for fixing over an entire area of the longitudinal width, including the boundary portion RY where the depressurization occurs. The nip pressure during non-address side fixing is set so as to form such a state. However, also in this case, it is desirable that the nip pressure is set so that the pressure P2 exerted on the boundary portion RY is substantially equal to the pressure P4 necessary for fixing in consideration of damage to the envelope S.

As described above, in this embodiment, in consideration of the depressurization occurring when the envelope S passes through the fixing nip U, a constitution in which the toner image can be fixed by making the nip pressure different between during address side fixing of the toner image on the envelope S and during non-address side fixing of the toner image on the envelope S was employed. As described above, the nip pressure (second nip pressure) during non-address side fixing is made higher than the nip pressure (first nip pressure) during address side fixing. As a result, irrespective of during address side fixing and during non-address side fixing, the pressure P2 (parts (a) and (b) of FIG. 10) exerted on the boundary portion RY can be made higher than the pressure P4 necessary for fixing. Therefore, over the entire area of the longitudinal width of the envelope S including the boundary portion RY where the depressurization occurs, the pressure exerted on the envelope S exceeds the pressure P4 necessary for fixing. As a result, irrespective of address side fixing and non-address side fixing, the envelope crease and the improper fixing resulting from the difference due to a difference in thickness intrinsic to the envelope S can be suppressed, so that fixing the toner image on the address side and the non-address side of the envelope S can be properly carried out.

Another Embodiment

Incidentally, in the above-described embodiment, the image forming apparatus having the constitution in which the toner images of the respective colors are primary-transferred from the photosensitive drums 1Y to 1K for the colors onto the intermediary transfer belt 8, and then the composite toner images are collectively secondary-transferred onto the envelope S was described, but the present invention is not limited thereto. For example, an image forming apparatus of a direct transfer type in which the toner images are directly transferred from the photosensitive drums 1Y to 1K onto the envelope S may also be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus capable of forming an image on an envelope including a first side and a second side opposite from the first side, the first side having a pasted portion where parts of a paper are pasted to each other, the second side not having a pasted portion where parts of a paper are pasted to each other and not having a flap, said image forming apparatus comprising:

an image forming portion configured to form a toner image on the envelope;

a fixing device including a fixing member, a heating portion configured to heat said fixing member, and a pressing member contacting said fixing member and forming a nip where the envelope is nipped and fed, wherein said fixing device is configured to fix the toner image on the envelope by heat and pressure;

a pressure changing mechanism configured to change pressure between said fixing member and said pressing member; and a controller configured to control said pressure changing mechanism such that the toner image is fixed on the envelope by causing said pressure changing mechanism to change the pressure to a first pressure when an instruction to form the image on the second side of the envelope is inputted and by causing said pressure changing mechanism to change the pressure to a second pressure when an instruction to form the image on the first side of the envelope is inputted, the second pressure being higher than the first pressure.

2. The image forming apparatus according to claim 1, further comprising an acquiring portion configured to acquire information on a basis weight of the envelope, wherein said controller is configured to control said changing mechanism to make the first pressure and the second pressure when the basis weight of the envelope is a first basis weight higher than the first pressure and the second pressure when the basis weight of the envelope is a second basis weight, the second basis weight being larger than the first basis weight.

3. The image forming apparatus according to claim 1, further comprising, a temperature detecting portion configured to detect a surface temperature of said fixing member, an acquiring portion configured to acquire information on a basis weight of the envelope, and an energization controller configured to control energization to said heating portion so that the surface temperature is a target temperature on the basis of an output of said temperature detecting portion, wherein said energization controller sets the target temperature at a first temperature when a basis weight of the envelope is a first basis weight and sets the target temperature at a second temperature higher than the first temperature when the basis weight of the envelope is a second basis weight, the second basis weight being larger than the first basis weight.

4. The image forming apparatus according to claim 1, further comprising, a first stacking portion configured to stack the envelope to be fed to a feeding passage for forming the toner image on an upper side of the envelope, a second stacking portion configured to stack the envelope to be fed to a feeding passage for forming the toner image on a lower side of the envelope, a selecting portion configured to select the stacking portion, a display portion configured to display information, and a input device configured to receive input identifying a side of the envelope on which the image is to be formed, wherein said controller causes said display portion to display a stacking method of the envelope stacked on the stacking portion selected on the basis of information inputted to said input device.

5. The image forming apparatus according to claim 4, wherein said first stacking portion is a manual feeding tray and said second stacking portion is a cassette.

6. The image forming apparatus according to claim 1, wherein said heating portion is a coil, and said fixing member includes an electroconductive layer generating heat by eddy current generated by magnetic flux.

7. The image forming apparatus according to claim 1, wherein said controller is capable of executing an operation in a double side print mode in which images are automatically formed on both the first side and the second side of the envelope.

* * * * *